US006056599A

United States Patent [19]

Flickinger et al.

[11] Patent Number: 6,056,599

[45] Date of Patent: May 2, 2000

[54] ELECTRICAL CONNECTOR WITH MATABLE CONTACT ASSEMBLY

[75] Inventors: Steven Lee Flickinger, Hummelstown; Lawrence Se-Jun Oh, Myerstown; Lori Ann Mayer, Harrisburg, all of Pa.; James Francis McIntire, Boring; Hans Arie Blom, Portland, both of Oreg.

[73] Assignee: The Whitaker Corporation, Wilmington, Del.

[21] Appl. No.: 08/866,474

[22] Filed: May 30, 1997

Related U.S. Application Data

[63] Continuation-in-part of application No. 08/731,910, Oct. 22, 1996, abandoned.

[51] Int. Cl.[7] ..... H01R 13/514

[52] U.S. Cl. ..... 439/598; 439/590; 439/651

[58] Field of Search ..... 439/598, 590, 439/650, 651, 655

[56] References Cited

U.S. PATENT DOCUMENTS

| | | | |
|---|---|---|---|
| 2,824,290 | 2/1958 | Archer et al. | 439/598 |
| 3,097,036 | 7/1963 | Cornell, Jr. | 439/598 |
| 3,129,993 | 4/1964 | Ross | 339/49 |
| 3,146,054 | 8/1964 | Shearer et al. | 339/113 |
| 3,160,457 | 12/1964 | Fischer | 339/91 |
| 4,060,303 | 11/1977 | Wilczynski | 339/147 |
| 4,391,482 | 7/1983 | Czeschka | 439/590 |
| 4,477,022 | 10/1984 | Shuey et al. | 439/590 |
| 4,586,607 | 5/1986 | Dubbs et al. | 439/590 |
| 4,653,839 | 3/1987 | Powell | 439/650 |
| 4,737,119 | 4/1988 | Stieler | 439/318 |
| 4,938,718 | 7/1990 | Guendel | 439/680 |
| 5,007,862 | 4/1991 | Defibaugh et al. | 439/607 |
| 5,643,010 | 7/1997 | Wu | 439/598 |
| 5,816,829 | 10/1998 | Chiang . | |

*Primary Examiner*—Paula Bradley
*Assistant Examiner*—Tho D. Ta
*Attorney, Agent, or Firm*—Salvatore Anastasi; Anton P. Ness

[57] ABSTRACT

An electrical connector which comprises a circular shell (20) in which a dielectric housing (44) having rows of electrical contacts (50) mounted therein is to be positioned, the electrical contacts including receptacle sections (52), matable electrical contacts (63, 81) having contact sections for matable engagement with the receptacle sections (52) and terminating sections for electrical connection to electrical conductors (54) of a cable (12), and dielectric contact-mounting members (67, 85, 87, 89) on which the matable electrical contacts (63, 81) are mounted whereby the matable electrical contacts are arranged in rows so that the contact sections of the matable electrical contacts (63, 81) of each row are electrically connected with the respective receptacle sections (52) of the electrical contacts (50) in the corresponding row of electrical contacts in the dielectric housing (44).

6 Claims, 6 Drawing Sheets

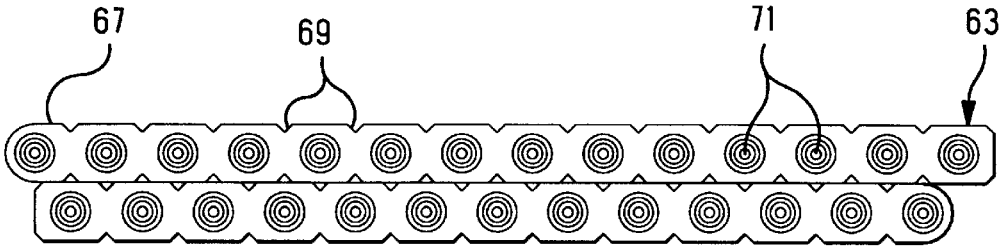
FIG. 7
FIG. 8
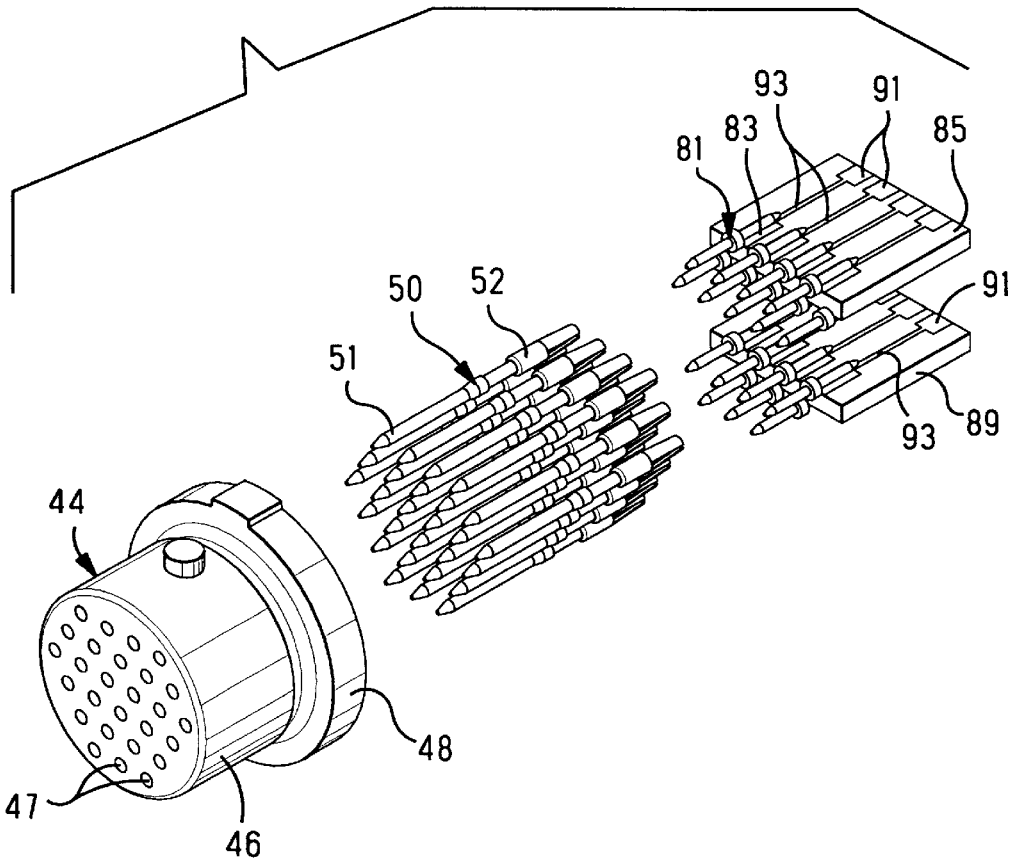

ELECTRICAL CONNECTOR WITH MATABLE CONTACT ASSEMBLY

CROSS REFERENCE TO RELATED APPLICATION

This patent application is a continuation-in-part application of U.S. patent application Ser. No. 08/731,910, filed Oct. 22, 1996 and now abandoned.

FIELD OF THE INVENTION

This invention relates to mass terminable electrical contact assemblies for electrical connectors with rows of electrical contacts. More particularly, the present invention relates to an electrical connector having a circular dielectric member in which rows of electrical contacts are mounted at closely-spaced intervals and matable with electrical contacts which have been mass terminated with electrical conductors of a cable.

BACKGROUND OF THE INVENTION

The electrical connector disclosed in the above application includes a contact assembly which comprises a dielectric member having electrical contacts secured therein. Electrical conductors of an electrical cable are individually connected to respective contact members of the electrical contacts by solder. Great effort and extensive time is required to make these electrical connections because the electrical conductors and contacts are very small.

In another known electrical connector, the solder sections of the electrical contacts that are secured in the dielectric member are disposed in staggered annular rows; however, soldering the electrical conductors individually to respective solder sections of the electrical contacts also requires extensive time and great effort.

Accordingly, terminating the electrical conductors of the cable to terminating sections of the electrical contacts at a faster rate and with less effort increases the production of the electrical connectors in addition to reducing the labor costs during the manufacture of the connectors.

SUMMARY OF THE INVENTION

An electrical connector according to the present invention comprises a circular shell in which a dielectric housing having electrical contacts mounted therein is to be positioned. The electrical contacts including receptacle sections are arranged in rows in the dielectric housing. Matable electrical contacts having contact sections for matable engagement with the receptacle sections are provided with terminating sections for electrical connection to electrical conductors of a cable. The matable electrical contacts are arranged in rows as part of dielectric contact-mounting members so that the contact sections of the matable electrical contacts of each row are electrically connected with the respective receptacle sections of the electrical contacts in the corresponding row of electrical contacts of the dielectric housing.

The matable electrical contacts of one embodiment of the invention are insert molded into a plastic carrier member forming a linear array of the matable electrical contacts. The conductors of a cable are respectively connected to the matable electrical contacts and rows of the desired number of matable electrical contacts are separated from the linear array of the matable electrical contacts thereby forming the rows of matable electrical contacts to be electrically connected to the cable conductors which are then matably connected with the receptacle sections of the electrical contacts in the dielectric housing.

The matable electrical contacts of another embodiment of the invention have their termination sections electrically connected to conductive pads on upper and lower surfaces at one end of circuit boards and the conductive pads are connected via conductive traces to conductive pads or holes at the other end of the circuit board thereby forming rows of matable electrical contacts having the desired number of matable electrical contacts corresponding to the electrical contacts in the dielectric member to which the matable electrical contacts are to be matably connected.

BRIEF DESCRIPTION OF THE DRAWINGS

Embodiments of the invention will now be described by way of example with reference to the accompanying drawings in which:

FIG. 7 is an end view of an embodiment of FIG. 4.

FIG. 8 is a perspective view of another embodiment of the electrical contacts in rows for matable connection with the receptacle contacts.

DETAILED DESCRIPTION OF THE INVENTION

Figure 1:
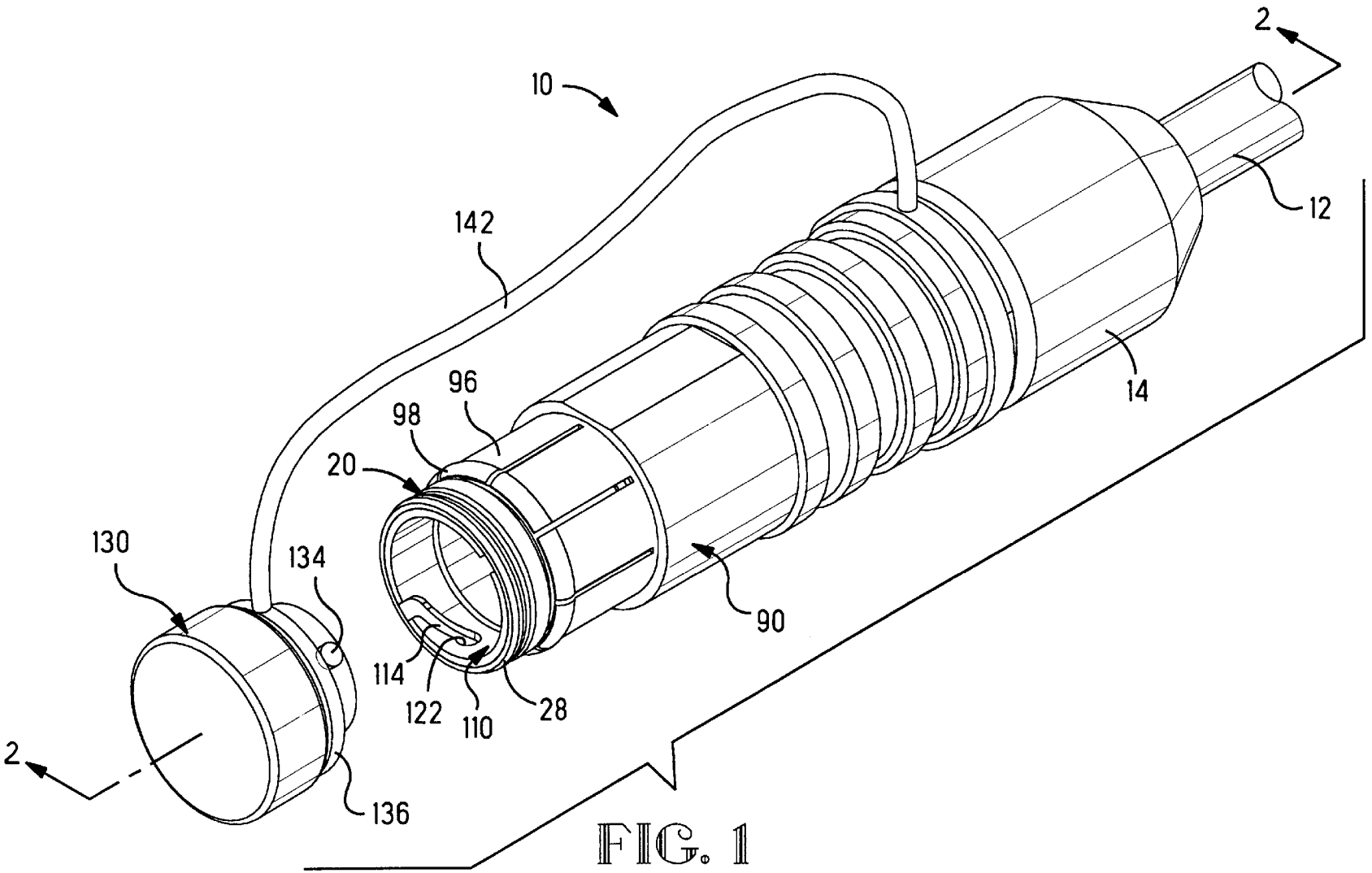
FIG. 1 is a perspective view of an electrical connector incorporating the present invention.
Figure 2:
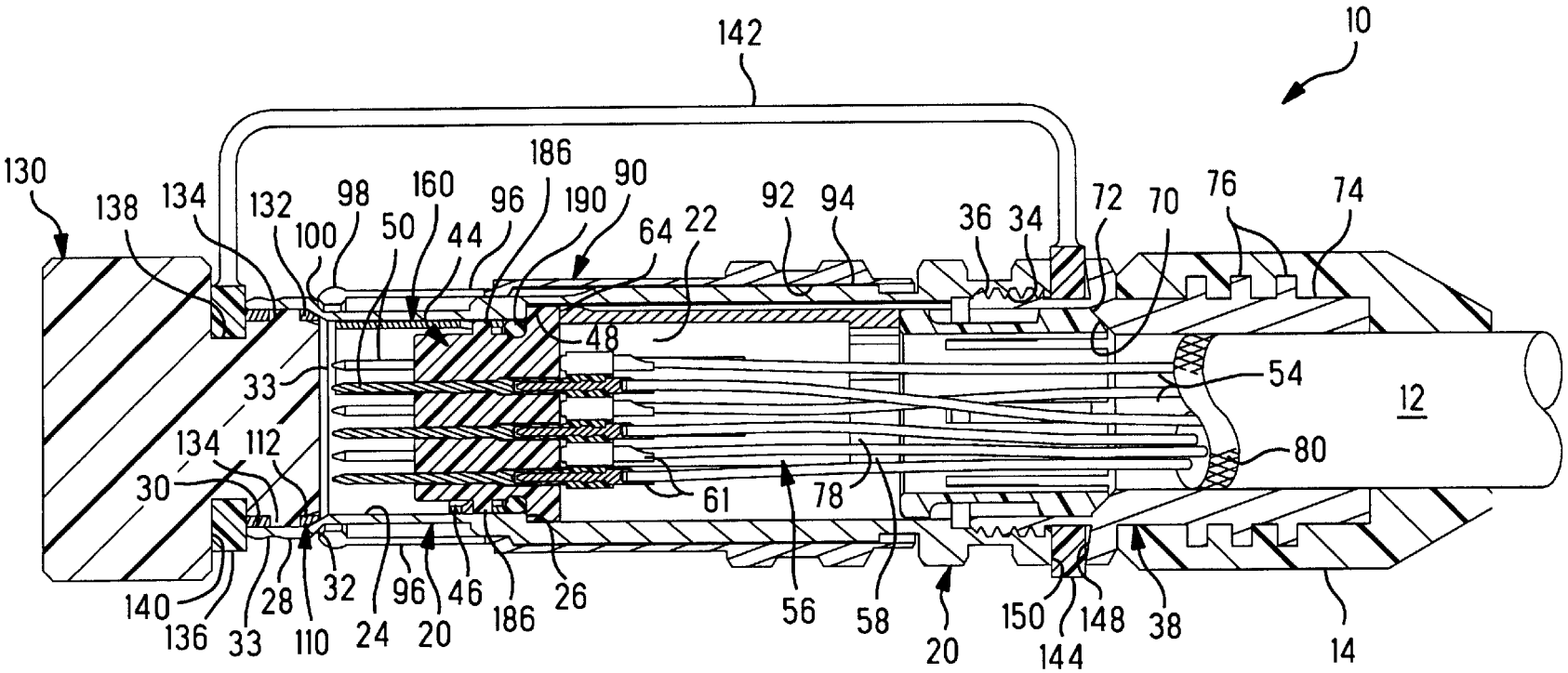
FIG. 2 is a cross-sectional view taken along line 2—2 of FIG. 1.
Figure 3:
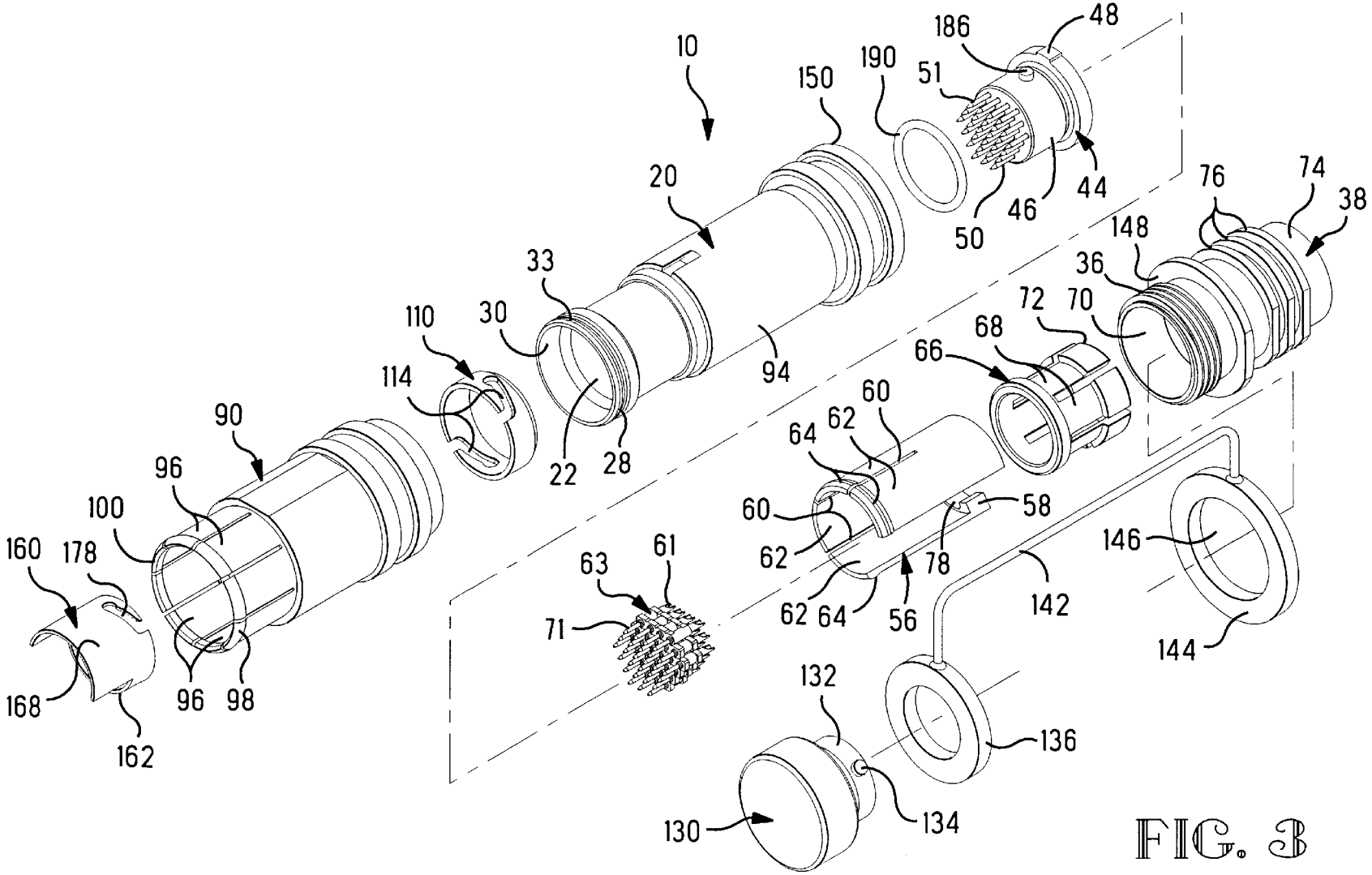
FIG. 3 is an exploded perspective view of the parts of the connector shown in FIG. 1.
Figure 6:
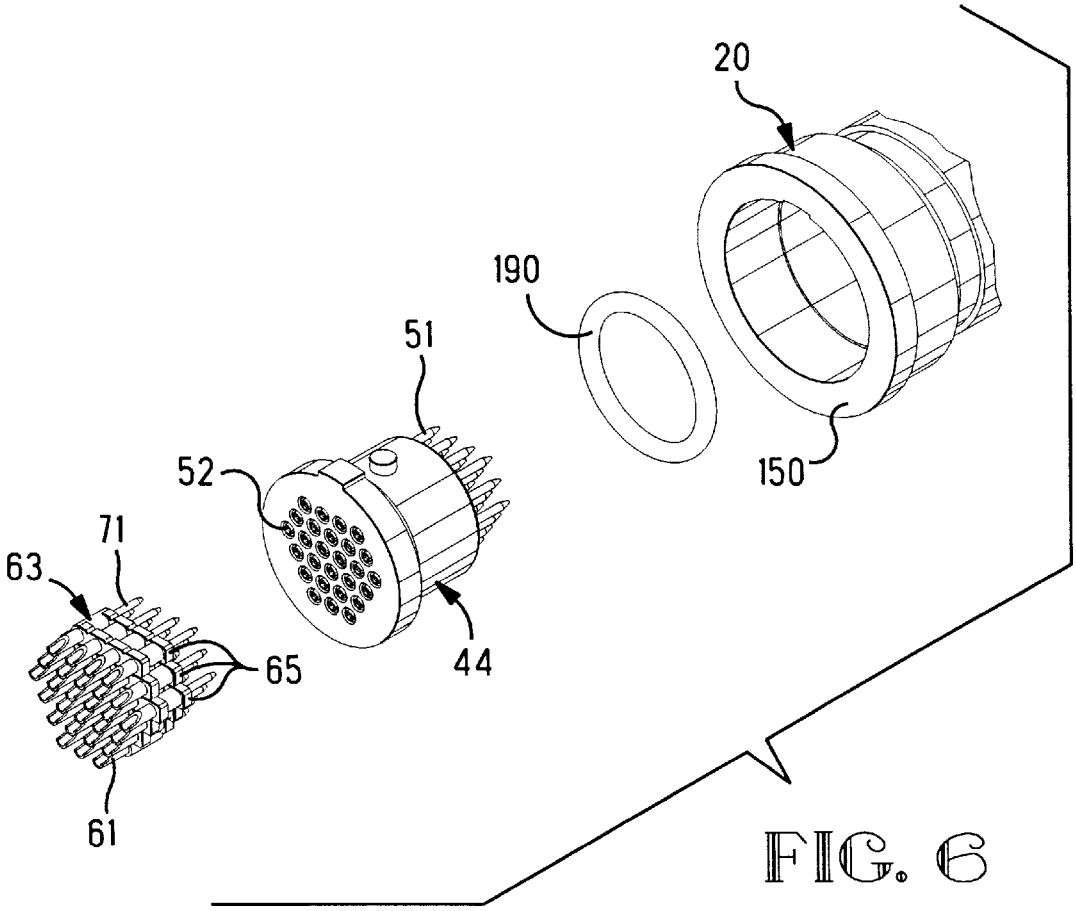
FIG. 6 is a perspective exploded view showing a contact housing, rows of receptacle contacts to be secured in the housing and rows of contacts for matable connection to the receptacle contacts.

In FIG. 1 an electrical connector 10 is terminated to an electrical cable 12 that is attached to a shank of the connector by means of an overmolded strain relief 14. The electrical connector 10 is arranged to mate with a mating connector (now shown). The electrical connector 10, as best seen in FIGS. 1–3, includes a cylindrically-shaped inner shell 20 having a bore 22 provided with a reduced inside diameter 24 forming a shoulder 26, and a flared end 28 having an inside diameter 30. The flared end 28 forms an angled camming surface 32 for a purpose that will be explained below. Additionally, the outer diameter of the flared end includes an annular depression 33, the purpose of which will also be explained below. The opposite end of the inner shell 20 includes an inside threaded diameter 34 for receiving a threaded end 36 of a back nut 38. A dielectric housing 44 having an outside diameter 46 and an outwardly extending flange 48 is disposed within the bore 22 with the flange against the shoulder 26, as best seen in FIG. 2. A plurality of electrical contacts 50 have contact sections 51 extending outwardly from the dielectric housing 44 toward the flared end 28 and include receptacle sections 52 disposed in passages 47 of housing 44 (FIG. 6). Passages 47 are disposed in rows in housing 44 with rows containing four, five, six, five, four and three passages.

The cable 12 includes a plurality of conductors 54 that extend into the bore 22, each conductor being connected to a respective terminating section 61 of electrical contacts 63 of contact assemblies 65 as best shown in FIG. 6 as will be explained below.

A C-shaped spacer member 56 includes an inwardly-turned flange 58 at one end thereof and three spaced slots 60 formed through the wall and extending from the other end thereof toward the flange 58, as best seen in FIG. 3. The spacer member 56 is arranged within the bore 22 so that the ends of arms 62 hold the flange 48 against the shoulder 26. The slots 60 form four resilient arms 62 that can elastically deflect a small amount. The ends of the arms 62 include radiused portions 64 that extend radially outward forming a portion of an outside diameter that is larger than the inside diameter of the bore 22 of shell 20 so that the radiused portions 64 are held tightly against the inner surface of the inner shell 20 by the resilient arms, as best seen in FIG. 2.

A split collet 66 having several cantilevered segments 68 is arranged in abutting engagement with the flange 58 of the spacer member 56 with the segments 68 extending away therefrom.

The back nut 38 includes a beveled interior surface 70 that engages outer edges 72 of the cantilevered segments 68 when the back nut is threaded into the threaded diameter 34 thereby urging the split collet 66 into firm engagement with the flange 58 of the spacer 56. As the back nut 38 is tightened, the outer edges 72 of the segments 68 cam radially inwardly to securely clamp onto the outer jacket of the cable 12. As best seen in FIG. 2, the back nut 38 includes a shank 74 having several ribs 76 to which the strain relief 14 is overmolded, in the usual manner. As shown in FIGS. 2 and 3, the flange 58 of the C-shaped spacer member 56 includes a surface 78 for receiving the end of shield 80, which is soldered in place to effect an electrical ground. The radiused portions 64 of the arms 62 provide good contact between the flange 58 and the inner shell 20, both of which are electrically conductive, thereby providing grounding continuity between the shield 80 and inner shell 20.

An outer shell 90 includes an inside diameter 92 that is a loose slip fit with an outside diameter 94 of the inner sleeve 20, as best seen in FIG. 2, so that the outer shell is free to slide somewhat toward and away from the flared end 28. Several annularly disposed arm segments 96 extend from the outer shell 90 toward the flared end 28. As shown in FIG. 2, each arm segment 96 terminates in a nub having an outer arcuate surface 98 and inner beveled surface 100 facing the angled surface 28.

A locking ring 110, as best seen in FIGS. 1–3, is disposed in the inside diameter 30 of the flared end 28 and is a press fit therein. The locking ring 110 includes an inside diameter that is equal to or greater than the reduced diameter 24 of the inner shell 20. A pair of locking slots 114 are formed in the side of the locking ring diametrically opposite each other. Each slot intersects a first end of the locking ring, then extends on a shallow angle toward a second end and terminates in a radius that extends slightly back toward the first end to form a detent. The second end is beveled to conform to the flared portion of the flared end 28 opposite the camming surface 32, as best seen in FIG. 2.

A protective cap 130 is arranged to seal the end of the connector 10 when the connector is submerged in a cleaning solution for sterilization. The protective cap 130 includes a reduced diameter 132 that is sized to be received within the inside diameter 112 of the locking ring 110. A pair of oppositely disposed lugs 134 extend outwardly from the reduced diameter 132 and are sized to be received within the locking slots 114 so that when the reduced diameter 132 is inserted into the locking ring 110, the lugs enter the locking slots 114. As the protective cap 130 is twisted in a counter-clockwise direction the lugs 134 follow the angled locking slots and enter the detents thereby holding the protective cap in tight sealing engagement with the end of the connector 10.

A sealing ring 136 of suitable gasket material is disposed within an annular slot 138 undercut in the reduced diameter 132 of cap 130. The undercut forms a shoulder 140 which presses the sealing ring 136 into sealing engagement with the flared end 28 so that cleaning solution cannot penetrate into the bore 22 of the inner shell 20 during submersion in the cleaning solution for sterilization. The protective cap 130 is held captive to the connector 10 by means of a flexible lanyard 142 which is attached at one end to the sealing ring 136 and at the other end to a retaining and sealing ring 144 having a hole 146 that closely fits over the threaded end 36 of the back nut 38. The retaining and sealing ring 144 is wedged between a shoulder 148 of the back nut 38 and an end 150 of the inner shell 20 in sealing engagement therewith, as best seen in FIG. 2. The sealing ring 136, lanyard 142, and retaining and sealing ring 144 may be of unitary construction or of separate parts suitably attached together to form a tether. These parts may be manufactured by molding, stamping out of sheet metal, or other suitable process.

As shown in FIGS. 2 and 3, a first keying member 160 is disposed within the reduced diameter 24 partly encircling the contacts 50. The first keying member 160 includes a ring-shaped base 162 and a part cylindrical-shaped portion or keying element 168 extending from the base 162. The ring-shaped base 162 includes a pair of locking slots 178 that are formed in the side of the base 162 diametrically opposite each other. Each slot intersects the first end of the base, then extends on a shallow angle toward the second end and terminates in a radius that extends slightly back toward the first end to form a detent. This detent is important because it angularly positions the keying member 160 within the connector 10. The base 162 has an inside diameter that is sized to be a loose slip fit with the outside diameter 46 of the dielectric housing 44, and has an outside diameter that is sized to easily slip into the reduced diameter 24 of shell 20 A pair of lugs 186 extend outwardly from opposite sides of the diameter 46 and are sized to be received in the locking slots 178. The first keying member 160 is assembled in the connector 10 by aligning its axis with the longitudinal axis of the connector and moving it into the opening of the inside diameter 112 and into the interior of the reduced diameter 24 of shell 20 until the base 162 slips over the end of the outside diameter 46 of the insert 44 and the lugs 186 engage in the locking slots 178. The first keying member 160 is then rotated about its axis in a clockwise direction so that the lugs 186 follow the angled locking slots 178 and enter the detents 182 thereby securing the first keying member in tight engagement with the dielectric housing 44.

A resilient ring 190 of suitable material is arranged between the flange 48 and the first end of the base 162. The ring 190 is resilient enough to compress as the lugs 186 follow the angled locking slots 178 and then to decompress a lesser amount as the lugs enter the detects so that the ring remains compressed enough to hold the lugs within the detents. This assembly of the first keying member 160 to the connector 10 is intended to be accomplished in the field by the end user of the connector. Keying member 160 is keyably matable with a complementary keying member in a matable connector to ensure that proper matable engagement takes place as explained in U.S. patent application Ser. No. 08/731,910 identified above. Further, the first keying member 160 may be removed from the connector 10 and a different first keying member installed.

The first keying member 160 and the complementary keying member may be removed from the connector 10 and the matable connector without taking the connectors apart, and a different matched pair of keying members installed when, for example, it is desired to change the keying arrangement of adjacent connectors on an equipment panel. It will be understood that the keying elements of the keying members may be positioned at different angular positions on their respective ring-shaped bases with respect to the detents thereby providing several different matched pairs having unique keying positions. The requirement is that each matched pair of keying members have keying elements that are angularly positioned with respect to their detents so that they complement each other, that is, they will allow the connectors to mate; however, they will not allow mating if the keying members are not members of the same matched pair with complementary-positioned keying elements.

Figure 4:
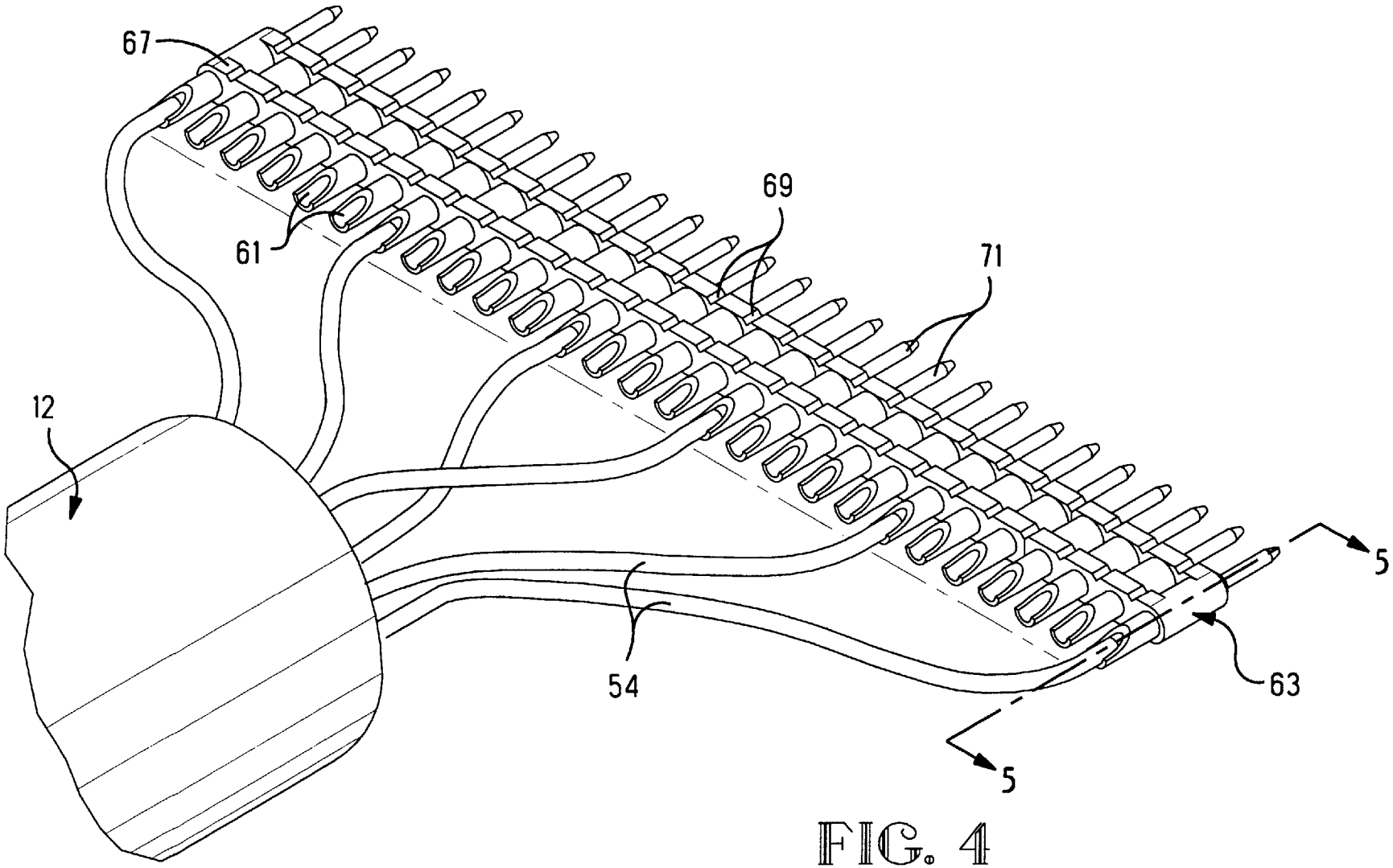
FIG. 4 is a perspective view of electrical contacts secured in a plastic carrier strip with electrical conductors of a cable connected to respective contacts.
Figure 5:
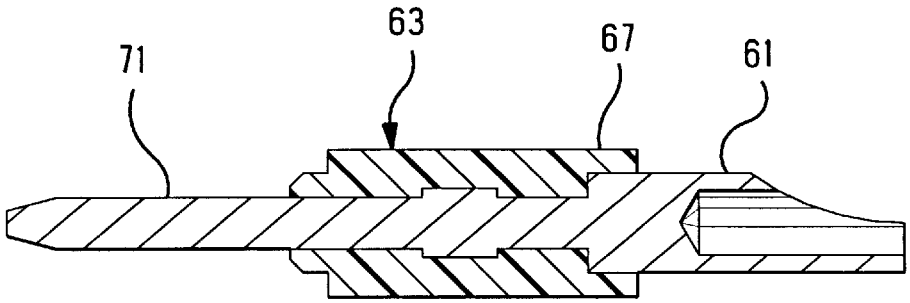
FIG. 5 is a cross-sectional view along line 5—5 of FIG. 4.

FIGS. 4 and 5 show electrical contacts 63 that are insert molded into a plastic carrier strip 67 thereby forming a continuous strip of electrical contacts in accordance with conventional molding practices. Carrier strip 67 has opposed V-shaped recesses 69 between adjacent contacts so that the carrier strip can be cut at the opposed V-shaped recesses and separated into contact assemblies 65 (FIG. 6) with the desired number of contacts.

Before cutting the strips of contacts into contact assemblies, a strip of contacts having the same number of contacts as conductors to be connected thereto is separated from the continuous strip of contacts and arranged as a linear strip of electrical contacts. Back nut 38, spacer member 56, and collet 66 are positioned onto cable 12 which has been stripped exposing conductors 54. Stripped ends of conductors 54 are positioned in respective terminating sections 61 of contacts 63, and they are simultaneously soldered to the conductors by applying heat to the terminating sections causing solder therein to flow and solder the conductors to the contact in accordance with conventional soldering practices.

If desired, the terminating sections 61 can be crimp members so that the conductors can be crimped thereto in accordance with conventional crimping practices.

After the conductors 54 are soldered to contacts 63, contact assemblies 65 are separated from the linear strip of contacts so that six rows of contact assemblies 65 (FIG. 6) having four, five, six, five, four and three contacts have the contact sections 71 matably connected with the receptacle sections 52 of the rows of contacts 50 in housing 44. This enables the conductors 54 connected to each contact assembly 65 to be terminated simultaneously to a linear row of the contacts 50. Rows of the proper number of contacts 63 are formed by separation from the linear strip of contacts which are then matably connected with the contacts 50 in housing 44.

In the event that conductors 54 would be too long causing a problem when assembling the connector into its completed form, linear strips of contacts with fifteen contacts in an upper row and twelve contacts in a lower row, as shown in FIG. 7, are positioned for receipt of conductors 54 in the respective terminating sections 61 of contacts 63 whereafter they are simultaneously terminated in the same manner as in FIG. 4. The contact assemblies 65 are then separated from the two contact strips and matably connected with the rows of contacts 50 in housing 44 as previously described.

After the contacts 50 and 63 are matably connected, housing 44 is positioned within bore 22 of shell 20 along with spacer member 56 and collet 66, then back nut 38 is threadably mounted onto shell 20 and strain relief 14 is overmolded onto back nut 38 and cable 12 thereby completing the assembly of the connector.

FIG. 8 shows another embodiment of the rows of electrical contacts on circuit boards instead of in strip form. As shown, electrical contacts 81 are double-pinned contacts with inner pins soldered to spaced conductive pads 83 at the front ends of circuit boards 85, 87, 89 on upper and lower surfaces thereof so that a first circuit board 85 has upper and lower rows of four and five contacts 81, a second intermediate circuit board, which is not shown for clarity, similarly has upper and lower rows of six and five contacts and a third circuit board 89 similarly has upper and lower rows of four and three contacts 81. Thus, the rows of contacts 81 on these circuit boards correspond to the rows of contacts 50 in housing 44 and the outer pins of contacts 81 are matably connected with the respective receptacle sections 52 of contacts 50.

The conductive pads 83 are connected to respective conductive pads 91 at the back ends of circuit board 85, 87, 89 via circuit traces 93 thereon. Conductive pads 91 are also connected via soldering to respective conductors 54 of cable 12; and, after contacts 50 and 81 are matably connected, housing 44 is positioned within bore 22 of shell 20 as heretofore explained. Plated through holes can be provided instead of conductive pads 91 in which conductors 54 are inserted and then soldered.

An advantage of the present invention is that the keying members are installed in the connector and mating connector in the field by the end user. This permits the easy establishment of unique keying for a group of adjacent connectors such as might be found on an equipment panel thereby preventing mismating of these connectors.

Another important advantage of the present invention is the mass termination of electrical conductors of a cable to electrical contacts in strip form or forms which are then separated into rows of contacts that are matably connected to electrical contacts in a housing thereby forming a contact assembly of an electrical connector. The conductors can be mass terminated to conductive pads on circuit boards which are connected to electrical contacts on the circuit boards that are matably connected to the electrical contacts in the housing thereby forming a contact assembly of an electrical connector.

We claim:

1. An electrical connector comprising, a circular shell in which a dielectric housing having electrical contacts mounted therein is to be positioned;

the electrical contacts including receptacle sections being arranged in rows in the dielectric housing;

matable electrical contacts having contact sections for matable engagement with the receptacle sections and terminating sections for electrical connection to electrical conductors of a cable; and a plurality of discrete dielectric contact-mounting members on which the matable electrical contacts are mounted, each of the dielectric contact-mounting members holding a row of the matable electrical contacts, the dielectric contact-mounting members being arranged in side-by-side relationship with the rows of matable electrical contacts extending parallel to each other, and the contact sections of each said row of matable electrical contacts are electrically connected with respective said receptacle sections of a corresponding said row of electrical contacts in the dielectric housing.

2. An electrical connector as claimed in claim 1, wherein the matable electrical contacts are insert molded into a plastic carrier member forming a linear array of the matable electrical contacts, the electrical conductors of the cable are connected to respective terminating sections of the matable electrical contacts, and rows of the matable electrical contacts having the desired number of matable electrical contacts are separated from the linear array of the matable electrical contacts thereby forming the rows of matable electrical contacts to be matably connected with the electrical contacts in the dielectric housing.

3. An electrical connector as claimed in claim 2, wherein the terminating sections are solder members in which the electrical conductors are to be soldered.

4. An electrical connector as claimed in claim 1, wherein the terminating sections of the matable electrical contacts are electrically connected to conductive pads at one end of circuit boards, the conductive pads are electrically connected to conductive areas at the other end of the circuit boards to which the electrical conductors of the cable are to be connected thereby forming rows of matable electrical contacts to be matably connected with the electrical contacts in the dielectric housing.

5. An electrical connector as claimed in claim 4, wherein the termination sections are pins soldered onto the conductive pads.

6. An electrical connector as claimed in claim 5, wherein the conductive pads and the conductive areas are located on the upper and lower surfaces of the circuit boards.

* * * * *